United States Patent [19]

Studebaker et al.

[11] Patent Number: 4,888,890

[45] Date of Patent: Dec. 26, 1989

[54] LASER CONTROL OF EXCAVATING MACHINE DIGGING DEPTH

[75] Inventors: Robert H. Studebaker; Ted L. Teach; Michael H. Kidwell, all of Huber Heights, Ohio

[73] Assignee: Spectra-Physics, Inc., San Jose, Calif.

[21] Appl. No.: 270,645

[22] Filed: Nov. 14, 1988

[51] Int. Cl.[4] ..... E02F 3/32

[52] U.S. Cl. ..... 37/103; 37/DIG. 1; 37/DIG. 14; 37/DIG. 19; 37/DIG. 20; 414/694; 33/263; 33/DIG. 21

[58] Field of Search ..... 37/103, DIG. 1, DIG. 14, 37/DIG. 19, DIG. 20; 414/694, 698, 699, 700, 701; 33/263, 264, 282, 283, DIG. 21; 116/DIG. 13

[56] References Cited

U.S. PATENT DOCUMENTS

| | | | |
|---|---|---|---|
| 3,233,349 | 2/1966 | Becton . | |
| 3,462,845 | 8/1969 | Matthews . | |
| 3,494,426 | 2/1970 | Studebaker . | |
| 3,557,372 | 1/1971 | Ede . | |
| 3,588,249 | 6/1971 | Studebaker | 33/DIG. 21 X |
| 3,825,808 | 7/1974 | Teach . | |
| 3,997,071 | 12/1976 | Teach | 414/698 |
| 4,034,490 | 7/1977 | Teach . | |
| 4,050,171 | 9/1977 | Teach | 37/DIG. 19 X |
| 4,062,634 | 12/1977 | Rando et al. . | |
| 4,129,224 | 12/1978 | Teach | 37/DIG. 1 X |
| 4,231,700 | 11/1980 | Studebaker | 414/700 |
| 4,273,196 | 6/1981 | Etsusaki et al. . | |
| 4,288,196 | 9/1981 | Sutton, II . | |
| 4,393,606 | 7/1983 | Warnecke | 37/DIG. 19 X |
| 4,413,684 | 11/1983 | Duncklee . | |
| 4,537,259 | 8/1985 | Funabashi et al. . | |

FOREIGN PATENT DOCUMENTS

| | | | |
|---|---|---|---|
| 3506326 | 8/1986 | Fed. Rep. of Germany | 37/DIG. 19 |

*Primary Examiner*—Dennis L. Taylor
*Assistant Examiner*—J. Russell McBee
*Attorney, Agent, or Firm*—Killworth, Gottman, Hagan & Schaeff

[57] ABSTRACT

A method and apparatus are provided for controlling the working depth of a bucket for an excavating machine having an outreach boom which is pivotally attached at one end to the machine, a downreach boom pivotally attached to the opposite end of the outreach boom, a digging bucket pivotally attached to the end of the downreach boom opposite to that to which the outreach boom is attached, and hydraulic power cylinders for moving the pivotally interconnected elements. A laser beam is projected at a reference height and a beam sensor mounted on the outreach boom of the machine detects the beam by means of a plurality of individual sensor locations. The angular orientation of the downreach boom relative to vertical is detected and a microprocessor controller connected to the beam sensor and the angle sensor repetitively defines, as a function of the angular orientation of the downreach boom, one of the plurality of individual sensor locations as an on-grade sensor location. The microprocessor controller compares the defined on-grade sensor location to the sensor location having detected the laser beam to generate an outreach boom adjustment signal representative of the movement of the outreach boom which is required to maintain the bucket on-grade as the downreach boom is pivoted with respect to the outreach boom.

34 Claims, 4 Drawing Sheets

LASER CONTROL OF EXCAVATING MACHINE DIGGING DEPTH

BACKGROUND OF THE INVENTION

The present invention relates generally to the use of a laser beam as a reference for controlling an excavating machine and, more particularly, to a method and apparatus for controlling such a machine to make linear digging strokes at a defined depth.

In recent years there has been increased use of laser beam projection systems in the construction industry. A laser beam rotated in a reference plane has been used to control the operation of various types of earth moving equipment, such as graders, scrapers, trenchers, and even excavating machines. Excavating machines will be used herein to refer to equipment for performing digging operations. Such equipment ranges from the largest self-controlled machines, referred to as "excavators," to the smallest machines, referred to as "backhoes," which may be attached to the rear end of a tractor. Due to the similar structure of such excavating machines, (i.e., an outreach boom pivotally connected to the machine, a downreach boom pivotally connected to the distal end of the outreach boom and a bucket pivotally connected to the distal end of the downreach boom) their normal digging stroke involves an arcuate movement of the downreach boom throughout the stroke. Unfortunately, not all excavating machine operators are sufficiently skilled that they can convert the arcuate movement of the downreach boom to a linear movement of the bucket parallel to a prescribed plane as is required to produce acceptable excavations.

One approach to applying laser control to an excavating machine, in this case a backhoe, to expand its capabilities and permit less skilled operators to dig flat trenches or the like, is disclosed in U.S. Pat. No. 4,231,700 issued Nov. 4, 1980 to Studebaker. The Studebaker system does not attempt to limit movement of the bucket to a planar stroke. Rather, the disclosed apparatus includes a detector mounted on a downreach boom which is kept in a fixed relationship with respect to a reference plane defined by a rotating laser beam. Although the detector is maintained at a fixed height, the cutting edge of the backhoe falls and rises during the digging stroke due to the pivoting action of the downreach boom. Thus, the bottom of a trench which is dug utilizing this system will not be flat.

A second approach is disclosed in U.S. Pat. No. 4,393,606 issued July 19, 1983 to Warnecke wherein an excavator uses a reference beam to permit the operator to control the bucket to make linear digging strokes. In the Warnecke system, a sensor is supported upon a mast which is in turn mounted directly on the upper part of the bucket. In Warnecke he sensor comprises a visually observable target such that an operator can control the excavator to maintain the laser beam centered upon the target to maintain a desired digging depth. Due to the nature of the bucket support, the orientation of the bucket remains constant throughout its digging stroke such that the desired target height of the beam striking the sensor is unchanged if the desired digging depth is maintained. Unfortunately, in an excavation of any depth, the Warnecke system requires placement of the laser source within the excavation and by locating the sensor on the bucket makes the sensor and the laser source readily susceptible to damage during the normal course of an excavation.

A third approach to laser control of the digging depth of an excavating machine is disclosed in U.S. Pat. No. 3,997,071 which issued Dec. 14, 1976 to Teach. In the Teach system, the angles between an outreach boom and horizontal, the outreach boom and the downreach boom, and the downreach boom and a line drawn to the digging teeth of the bucket are monitored and processed in accordance with trigonometric equations to provide a continuous signal and visual indication proportional to the depth of the digging teeth of the bucket relative to the mounting axis of the outreach boom. The absolute depth of the digging teeth of the bucket may be determined and displayed in the Teach system by measuring the absolute elevation of the mounting axis of the outreach boom relative to a reference plane defined by a rotating laser beam. In the Teach system, a beam sensor supported upon a movable mast is continually adjusted such that a defined section of the sensor is engaged by the rotating laser beam. Movements of the mast are monitored to determine the elevation of the axis of the outreach boom from which the absolute elevation of the digging teeth of the bucket can be determined and displayed.

A further advance of laser controlled excavating machines is disclosed in U.S. Pat. No. 4,129,224 which also issued to Teach on Dec. 12, 1978. In this system, the angles between the pivotally mounted elements of the excavating machine, in this case a backhoe, are monitored and applied to trigonometric equations such that the attack angle of the digging teeth of the bucket of the machine move parallel to a desired slope of an excavation throughout the digging stroke. Unfortunately, the mast structure and angle sensing apparatus must be extremely accurate to accurately control the depth of digging of an excavating machine. Hence, this system is relatively complicated and expensive.

Accordingly, there is a need for a simplified method and apparatus for operating an excavating machine in a manner such that linear digging strokes are made by the machine bucket at a defined depth.

SUMMARY OF THE INVENTION

This need is met by the present invention by providing a method and apparatus for controlling the working depth of a bucket of an excavating machine in response to a beam of laser light which is projected at a reference height. A beam sensor is positioned such that one of a plurality of individual sensor locations is illuminated by the laser beam with the illuminated sensor location being compared to an on-grade sensor location which is repetitively defined as a function of the angular orientation of the downreach boom relative to vertical. This comparison is used to generate an outreach boom adjustment signal which is representative of the movement of the outreach boom which is required to maintain a bucket of the excavating machine on-grade as the downreach boom is pivoted with respect to the outreach boom.

In accordance with one aspect of the present invention, apparatus is provided for controlling the working depth of a bucket of an excavating machine. The excavating machine is of the type having an outreach boom which is pivotally attached at one end to the machine, a downreach boom pivotally attached to the opposite end of the outreach boom, a digging bucket pivotally attached to the end of the downreach boom opposite to that to which the outreach boom is attached, and power means for producing relative pivotal movements of the pivotally interconnected elements. The apparatus comprises laser beam projection means for projecting a beam of laser light at a reference height and beam sensor means mounted on the outreach boom of the machine for detecting the beam of laser light with the beam sensor means defining a plurality of individual sensor locations. Angle sensor means are provided for detecting the angular orientation of the downreach boom relative to vertical. Control means are connected to the beam sensor means and the angle sensor means for repetitively defining, as a function of the angular orientation of the downreach boom, one of the plurality of individual sensor locations as an on-grade sensor location for the beam sensor means. The control means also provides for comparing the defined on-grade sensor location to the sensor location having detected the beam of laser light to generate an outreach boom adjustment signal representative of the movement of the outreach boom which is required to maintain the bucket on-grade as the downreach boom is pivoted with respect to the outreach boom.

The digging bucket may be held in a fixed position with respect to the downreach boom or may be manually controlled to maintain the attack angle of the bucket. Alternately, bucket control means may be provided to maintain the bucket at a fixed orientation relative to vertical such that the attack angle of the bucket is constant throughout the digging stroke. The apparatus may further comprise tilt sensor means for sensing a tilt angle of the excavating machine. Where such tilt sensor means is provided, the control means is responsive to the tilt angle for defining the on-grade sensor location to thereby more accurately control the working depth of the bucket.

The control means preferably comprises activation means responsive to the outreach boom adjustment signal for controlling the movement of the outreach boom to automatically maintain the digging edge of the bucket on-grade. The beam sensor means is preferably mounted at the pivoting interconnection of the downreach boom to the outreach boom. However, the beam sensor means may be mounted at any location along the outreach boom provided the control means compensates for the movement of the downreach boom.

The beam sensor means preferably comprises a plurality of linearly arranged photocells, individual ones of which photocells define the plurality of individual sensor locations. To be more readily adaptable for various excavating jobs, the beam sensor means also may be adjustably mounted such that the height and the angular orientation relative to vertical of the beam sensor means can be adjusted. Further, alignment means may be provided for maintaining the beam sensor means in a substantially vertical orientation. The alignment means may comprise a pendulum device, parallelogram linkage, active control system or the like.

The angle sensor means may comprise: an angle sensor mounted on the downreach boom: an angle sensor mounted at the base of the outreach boom adjacent the machine and angle detection means for measuring the relative angle between the outreach boom and the downreach boom; or an angle sensor mounted on the machine and angle detection means for measuring the relative angles between the machine and the outreach boom and between the outreach boom and the downreach boom.

According to another aspect of the present invention, a method is provided for controlling the working depth of a bucket of an excavating machine. The machine has an outreach boom which is pivotally attached at one end to the machine, a downreach boom pivotally attached to the opposite end of the outreach boom, a digging bucket pivotally attached to the end of the downreach boom opposite to which the outreach boom is attached, and power means for producing relative pivotal movements of the pivotally interconnected elements. The method comprises the steps of: projecting a beam of laser light at a reference height; detecting a beam of laser light by means of a beam sensor which defines a plurality of individual sensor locations; detecting the angular orientation of the downreach boom relative to vertical; defining one of the plurality of individual sensor locations as an on-grade sensor location of the beam sensor as a function of the angular orientation of the downreach boom; and comparing the on-grade location to the sensor location currently sensing the beam of laser light to generate an outreach boom adjustment signal representative of the movement of the outreach boom required to maintain the bucket on-grade as the downreach boom is pivoted with respect to the outreach boom with the digging bucket being held in a fixed position with respect to the downreach boom. The method may further comprise the step of maintaining the bucket at a fixed orientation relative to vertical, or holding the bucket in a fixed orientation relative to the downreach boom.

The method preferably may further comprise the step of controlling the movement of the outreach boom in response to the outreach boom adjustment signal to automatically maintain the digging edge of the bucket on-grade. The method may also further comprise the step of sensing a tilt angle of the excavating machine in which case the step of defining an on-grade sensor location is responsive to the tilt angle.

Accordingly, it is an object of the present invention to provide a method and apparatus for operating an excavating machine such that its bucket is maintained at a defined working depth during a digging stroke of the downreach boom of the machine; to provide such a method and apparatus in which the depth of the distal end of the downreach boom is determined by means of a reference laser beam; and, to provide such a method and apparatus in which variations in the height of the digging edge of its bucket resulting from variations in the angular orientation of the downreach boom are compensated by repetitively defining an on-grade sensor location of a beam sensor and comparing that on-grade sensor location to the sensor location currently sensing the beam of laser light to generate an outreach boom adjustment signal which is used for such compensation.

Other objects and advantages of the invention will be apparent from the following description, the accompanying drawings and the appended claims.

DETAILED DESCRIPTION OF THE INVENTION

Figure 1:
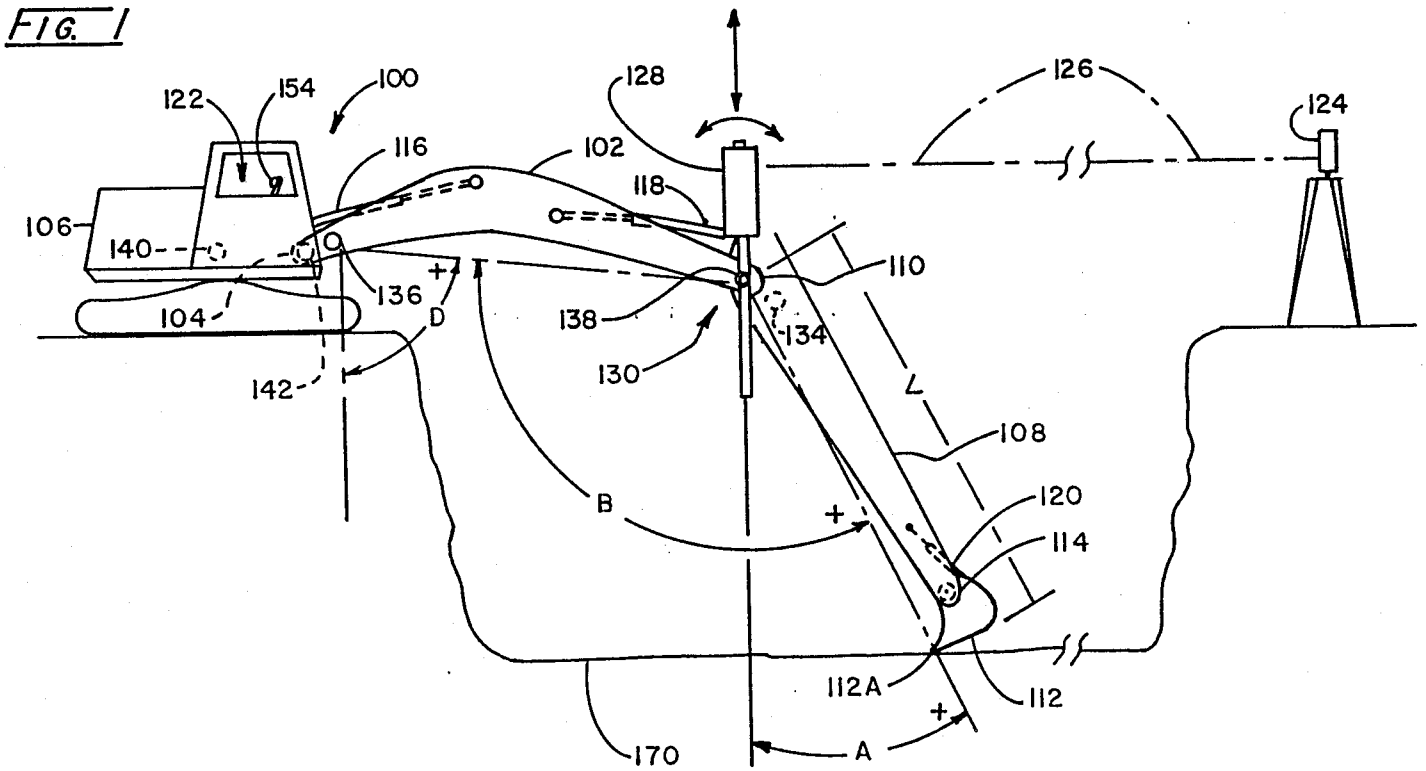
FIG. 1 is a schematic view of an excavator incorporating the present invention.

FIG. 1 illustrates an excavator 100 of the type which may be controlled by the method and apparatus of the present invention. The excavator 100 includes an outreach boom 102 which is pivotally attached at one end 104 to the main body 106 of the excavator 100. A downreach boom 108 is pivotally attached to the opposite end 110 of the outreach boom 102. A digging bucket 112 is pivotally attached to the end 114 of the downreach boom 108 opposite to that to which the outreach boom 102 is attached. Power means comprising hydraulic cylinders 116, 118 and 120 produce relative pivotal movements of the pivotally interconnected elements 102, 108 and 112. It will be appreciated that although the present invention is illustrated in conjunction with an excavator, nevertheless, it is equally applicable to a wide variety of excavating machines ranging from the largest excavators to the smallest backhoes.

Each of the cylinders 116, 118 and 120 respectively controls the angular position D of the outreach boom 102 relative to the main body 106 of the excavator 100, the pivotal position of the downreach boom 108 relative to the outreach boom 102, and the position of the bucket 112 with respect to the distal end 114 of the downreach boom 108. Each such cylinder may be manually controlled by conventional individual hydraulic valve controls (not shown) positioned immediately adjacent an operator's position 122. By varying the angle of the outreach boom 102 relative to the excavator 100 and the downreach boom 108 relative to the outreach boom 102, the digging bucket 112 may be moved to a digging position. The path of the digging bucket 112 through the ground is controlled by the operator by making the appropriate variations of the relative angles between the outreach boom 102 and the excavator 100, the downreach boom 108 and the outreach boom 102, and possibly the digging bucket 112 and the downreach boom 108.

Operation of the present invention relies upon a laser beam projection means such as a beam projector 124 for projecting a beam 126 of laser light at a reference height. Preferably, the beam projector 124 rotates the laser beam 126 about a substantially vertical axis to define a reference plane of laser light which may be detected at the excavation site. The beam projector 124 may be any of a number of known beam projection devices such as one of those disclosed in U.S. Pat. Nos. 3,588,249 or 4,062,634. Laser beam sensor means comprising an elongated beam receiver 128 is mounted on the outreach boom 102, preferably at the pivoting interconnection of the downreach boom 108 to the outreach boom 102. If the beam receiver 128 is mounted elsewhere along the outreach boom 102, appropriate compensation must be performed to account for differences in vertical movement between the beam receiver 128 and the end 110 of the outreach boom 102 as will be apparent to those skilled in the art. The additional error due to the differences in vertical movement can be calculated from the angle of the outreach boom relative to horizontal and the distance between the mounting point and the pivot point between the outreach boom 102 and the downreach boom 108. Such error is minimized and can be ignored if the distance between the mounting point and the pivot point is sufficiently small.

To facilitate set up and operation of the present invention, the elongated beam receiver 128 is adjustably mounted such that its height and angular orientation relative to vertical can be adjusted as shown in FIG. 1.

Figure 2:
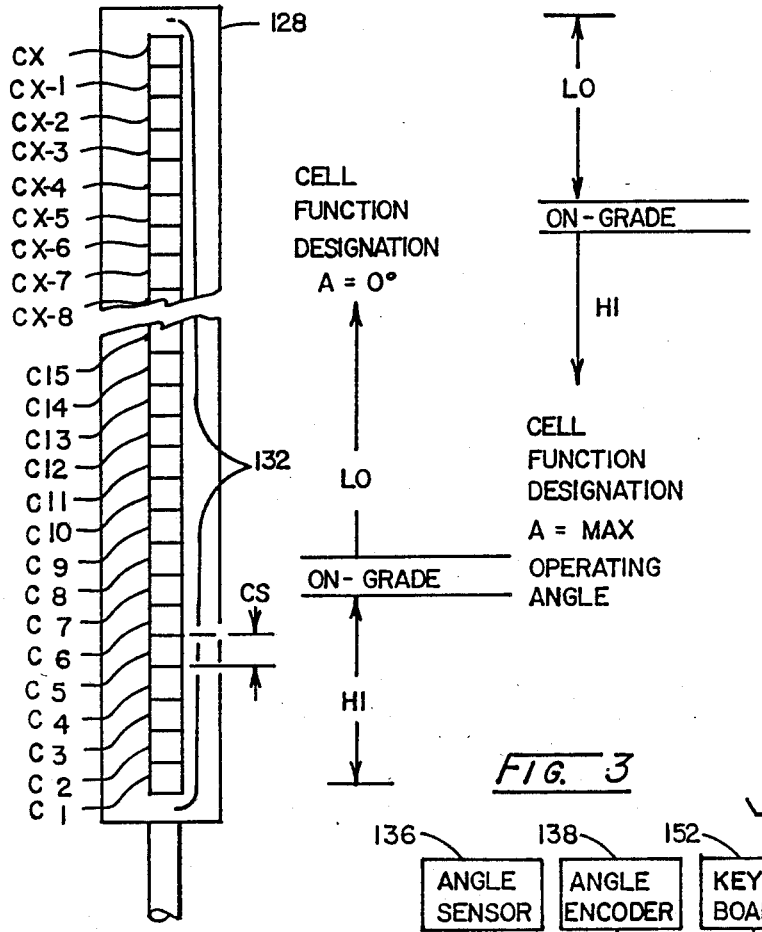
FIG. 2 is a schematic view of a laser receiver for use in the present invention and illustrates the dynamic designation of the various cells of the receiver during operation of the present invention.

The face of the elongated beam receiver 128 which is directed toward the beam projector 124 for receiving the laser beam 126 is shown in FIG. 2 and comprises a linearly arranged array of photocells 132 designated C1 through CX. Individual ones of the photocells C1 through CX define a plurality of individual sensor locations along the elongated beam receiver 128.

Even though the elongated beam receiver 128 is normally adjusted to vertical before operation of the system, small errors are created when the receiver is not vertical, for example due to the movement of the outreach boom 102. Such errors are generally insignificant and can be ignored; however, if necessary; alignment means can be provided for maintaining the elongated beam sensor 128 in a substantially vertical orientation. For example, a pendulum device, indicated by the weight 128A in FIG. 6, can be provided. Other alignment means can comprise a parallelogram control linkage, active control system or other arrangement which will be apparent to those skilled in the art.

Angle sensor means is provided for detecting the angle A defining the angular orientation of the downreach boom 108 relative to vertical. A variety of angle sensor means can be provided. For example, an angle sensor 134 may be mounted on the downreach boom 108. Such an angle sensor may be controlled by gravity and is commercially available from Humphrey Inc. of San Diego, California as Model No. CP17-0647-5.

The angle sensor 134 may be subjected to forces in addition to gravity due to the motion of the outreach boom 102 and the downreach boom 108. Accordingly, an alternate and preferred embodiment of the angle sensor means comprises an angle sensor 136, for example the device commercially available from Humphrey Inc., and angle detection means which may comprise an angle encoder 138, for measuring the relative angle between the outreach boom 102 and the downreach boom 108. The angle encoder 138 may comprise an angle measuring element commercially available from BEI Motion Systems Company of Goleta, California, for example.

A third alternate for the angle sensor means comprises an angle sensor 140 mounted on the main body 106 of the excavator 100 near the base of the machine such that it is least affected by forces generated by movement of the machine, and angle detection means comprising angle encoders 142 and 138 for measuring the relative angles between the main body 106 of the machine 100 and the outreach boom 102 and between the outreach boom 102 and the downreach boom 108.

Figure 5:
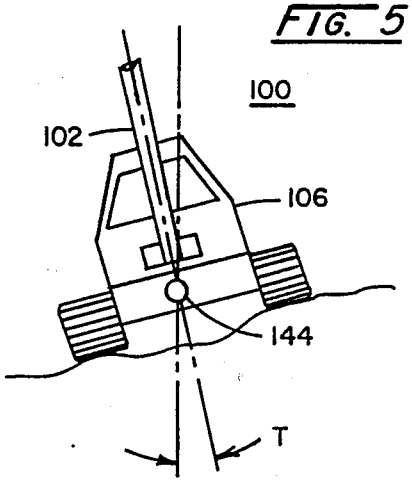
FIG. 5 is a front view of an excavator illustrating tilt angle sensing for tilt angle compensation in accordance with the present invention.

If the excavator 100 is to be used under conditions where there is a side-to-side slope, the invention may also comprise tilt sensor means for sensing a tilt angle T of the excavator 100. As shown in FIG. 5, tilt sensor means comprises an angle sensor 144, for example the device commercially available from Humphrey Inc.

Figure 3:
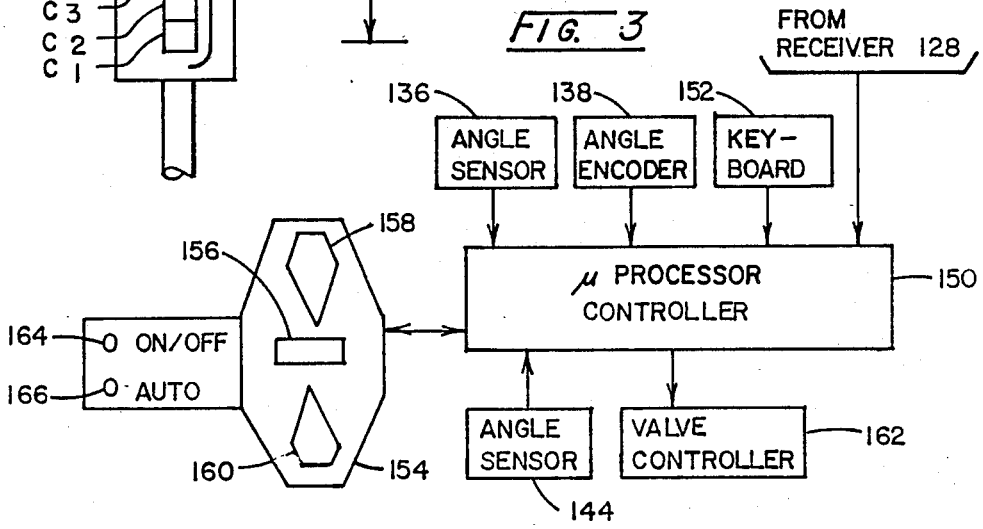
FIG. 3 is a block diagram of a microprocessor control system for use in the present invention.

Control means taking the form of a microprocessor controller 150 as shown in FIG. 3 is connected to the beam sensor means comprising the elongated beam receiver 128 and the angle sensor means preferably comprising the angle sensor 136 and the angle encoder 138. Input means, such as a keyboard 152, is connected to the microprocessor controller 150 on a permanent or selective basis to permit input of parameters for the microprocessor controller 150. The control means respectively defines, as a function of the angular orientation of the downreach boom 108, one of the plurality of individual sensor locations C1 through CX as an on-grade sensor location for the receiver 128. When the excavator 100 is to be used under side-to-side sloping conditions, the microprocessor controller 150 is also connected to the angle sensor 144. For such applications, the definition of an on-grade sensor location is also a function of the tilt angle T as sensed by the angle sensor 144.

The on-grade sensor location thus defined is compared to the sensor location which has detected the beam of laser light 126 from the beam projector 124 to generate an outreach boom adjustment signal. The outreach boom adjustment signal is representative of the movement of the outreach boom 102 which is required to maintain the bucket 112 on-grade as the downreach boom 108 is pivoted with respect to the outreach boom 102. The digging bucket 112 may be held in a fixed position with respect to the downreach boom 108, such that the digging edge 112A of the bucket 112 is maintained on-grade. Alternately, the bucket 112 may be manually or automatically controlled to maintain a substantially fixed bucket orientation relative to vertical such that the angle of attack of the bucket is maintained substantially constant throughout the digging stroke of the excavator 100. The later type operation is shown in FIG. 6.

Figure 6:
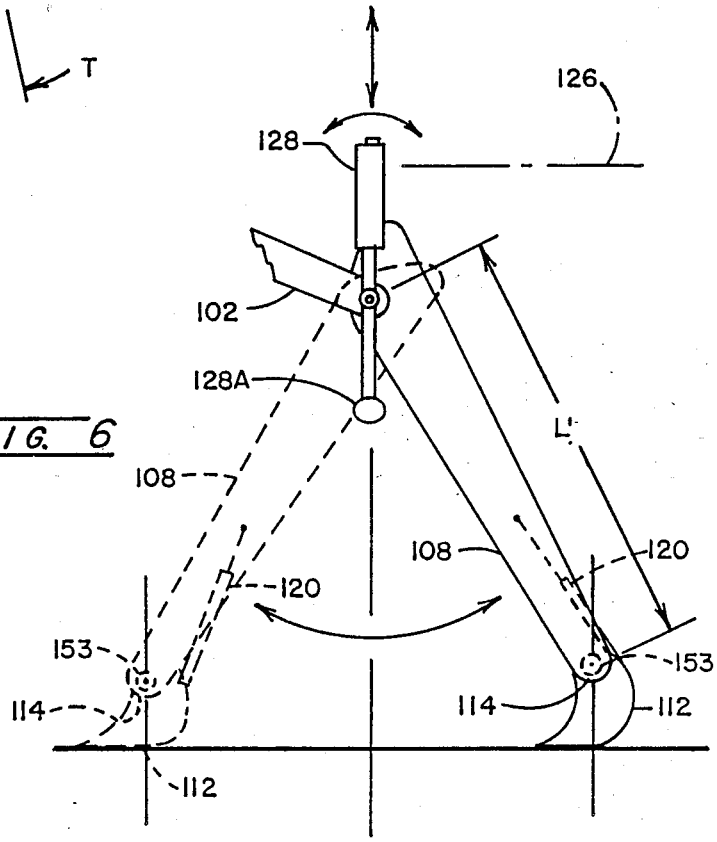
FIG. 6 illustrates maintenance of the bucket at a fixed angle relative to vertical to set a constant bucket attack angle throughout a digging stroke.

As shown in FIG. 6, the bucket 112 is maintained at a desired, substantially constant angle relative to vertical by means of manual or automatic control of the hydraulic cylinder 120. For automatic control, the orientation of the bucket 112 can be monitored by an angle sensor 153, for example the device commercially available from Humphrey Inc., such that the bucket 112 can be maintained at the desired angle. Control of the bucket 112 can also be in accordance with Teach's referenced U.S. Pat. No. 4,129,224 which is incorporated herein by reference. It is noted that the effective controlled length L is a combination of the downreach boom 108 and the bucket 112 when the bucket 112 is held in a fixed position relative to the downreach boom 108. On the other hand, when the bucket 112 is held in a fixed position relative to vertical, the controlled length is L', the distance between the outreach boom 102/downreach boom 108 pivot point and the downreach boom 108/bucket 112 pivot point. See FIGS. 1 and 6 respectively.

The outreach boom adjustment signal is passed to a three light display 154 which includes a light 156 indicating that the digging bucket 112 is on-grade, a light 158 indicating that the digging bucket 112 is high or above grade, and a light 160 indicating that the digging bucket 112 is low or below grade. An operator of the excavator 100 can view the three light display 154 for manual control of the digging depth of the excavator 100. Preferably, however, the microprocessor controller 150 includes activation means responsive to the outreach boom adjustment signal for controlling the movement of the outreach boom 102 via a valve controller 162 to automatically maintain the digging bucket 112 on-grade. Illuminated switches 164 and 166 provide on/off control and the selection of the manual or automatic mode of the system respectively with the signals from the switches 164 and 166 being passed to the microprocessor controller 150.

Figure 4:
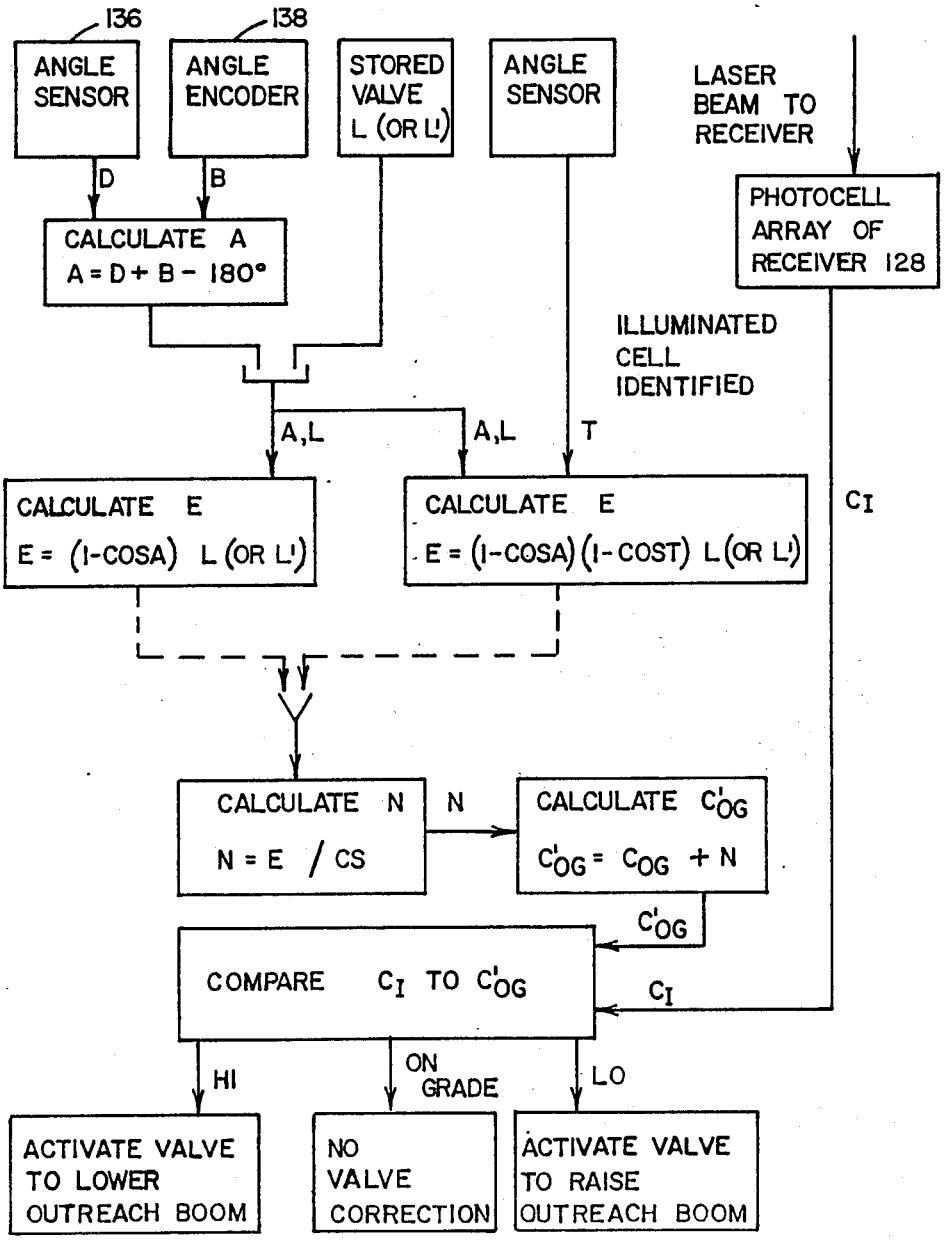
FIG. 4 is a block diagram illustrating generation of an outreach boom adjustment signal for indicating or controlling the movement of the outreach boom in accordance with the present invention to maintain the bucket of the excavator on-grade.

A better understanding of the operation of the control means shown in FIG. 3 can be obtained from a review of the block diagram of FIG. 4 which represents operation of the control means for the preferred embodiment of the system with the angle sensor 136 and the angle encoder 138. The system can be operated with the bucket 112 fixed relative to the downreach boom 108 in which case L is entered into the microprocessor controller 150, or with the bucket 112 fixed relative to vertical (either manually or automatically) in which case L' is entered into the microprocessor controller 150. System control with and without side-to-side tilt sensing is also shown in FIG. 4.

A geometric analysis of FIG. 1 reveals that the angle A which is the angular deflection of the downreach boom 108 from vertical is equal to the angle D which is the angular deflection of the outreach boom 102 from vertical plus the angle B which is the angular orientation of the downreach boom 108 relative to the outreach boom 102 minus 180°. An error length E created by an angular deflection of the downreach boom 108 from vertical is equal to $(1-\cos A)$ times the length L of the combination of the downreach boom 108 and the digging bucket 112, i.e., the length from the pivotal interconnection of the outreach boom 102 and the downreach boom 108 to the digging edge of the digging bucket 112, see FIG. 1, if the bucket 112 is fixed relative to the outreach boom 108. Alternatively, the length L' is used if the bucket is fixed relative to vertical, see FIG. 6. For side-to-side tilt correction, an additional term $(1-\cos T)$ where T is the tilt angle as shown in FIG. 5 must also be included.

In a working embodiment of the present invention, the pivotal movement of the downreach boom 108 is controlled over an angular range of ±30° from vertical and the length L is set equal to 134 inches which was entered into the microprocessor controller 150 by means of the keyboard 152. The spacing between the photocells C1 through CX was set equal to 0.5 inches (defined as the cell spacing CS) for the receiver 128, see FIG. 2. The calculated error length E is converted to an equivalent number of photocells dividing E by the cell spacing CS. The resulting error number N, representative of the number of photocells which are displaced due to the error created by the angular offset of the downreach boom 108, is added to the on-grade cell $C_{OG}$ to define one of the plurality of individual sensor locations as an on-grade sensor location $C'_{OG}$ for the given angular offset.

The defined on-grade sensor location $C'_{OG}$ is then compared to the illuminated cell $C_I$ which is identified by the photocell array 132 of the receiver 128 to determine whether the digging edge of the digging bucket 112 is on-grade, high or low. If the system is turned on by means of the illuminated switch 164 and has been placed in the automatic mode by operation of the illuminated switch 166, a corresponding operation will be performed by the valve controller 162. Of course, if the digging edge of the digging bucket 112 is on-grade, no valve correction is performed and the outreach boom 102 is maintained in its given position. If the digging edge of the digging bucket 112 is high, the valve controller 162 is activated to lower the outreach boom 102 to compensate for the error created by the angular offset of the downreach boom 108. On the other hand, if the digging edge of the digging bucket 112 is low, the valve controller 162 is activated to raise the outreach boom 102 to compensate for the error created by the angular offset of the downreach boom 108.

For the working embodiment with L equal to 134 inches, at the extreme angles of ±30°, the error is equal to 18 inches and it was desired to have at least 3 inches of photocells beyond the on-grade cell. Accordingly 3 inches of cells were added at each end to result in a 24 inch length for the photocell array 132 with the receiver 128 being slightly longer to properly house the photocell array 132. Accordingly, for this working system, CX was equal to C48. For production systems it would be reasonable to provide at least two lengths for the receiver 128, one for small machines and one for large machines.

The hydraulic valve which controls the cylinder 116 in the simplest system would be a single constant flow valve which would be activated between machine cycle operations of the microprocessor controller in accordance with the outreach boom adjustment signal. Alternately, multiple solenoid valves could be provided to provide different rates of flow of hydraulic fluid depending on how far the illuminated cell $C_I$ was spaced from the defined on-grade cell $C'_{OG}$ which was calculated by the system. A third alternate would be to use a proportional control valve which would adjust the flow of hydraulic fluid in direct correspondence with the distance the illuminated cell $C_I$ is spaced from the defined on-grade cell $C'_{OG}$ which is calculated by the system.

Operation of the laser controlled excavating machine by the working embodiment will now be described. Assuming that the beam projector 124 and the system have been turned on and that the length of value L has been entered into the system, the operator manually controls the excavator 100 until finished grade has been reached. At this time, the operator sets the digging edge of the digging bucket 112 on the final grade location and adjusts the vertical and angular positioning of the elongated receiver 128 such that the signal at the three light display 154 is reading on-grade. At this time, the system is in the manual mode and there are no outputs to the valve controller 162.

Once the elongated receiver 128 has been set, the operator can switch the system from the manual mode to the automatic mode by means of the illuminated switch 166 and continue the digging operation. During a typical dig cycle, the operator moves the digging bucket 112 down into the excavation until the downreach boom 108 is within the ±30° operating range. Once one of the photocells C1 through CX is illuminated by the laser beam 126, the system takes over and automatically provides signals to the valve controller 162 which controls the outreach boom 102 such that the receiver 128 is positioned with the presently defined on-grade cell illuminated by the laser beam 126. Since the downreach boom 108 is moving through its operating range of ±30°, the defined on-grade cell is continuously changing and therefore, the system is making corrections continuously.

With the downreach boom 108 extended outwardly (Angle A=+30°), the system positions the digging bucket 112 to the on-grade position. Since the angle A is at its maximum, the on-grade cell is in its highest position near the top of the elongated receiver 128, see FIG. 2. As the operator moves the downreach boom 108 toward the main body 106 of the machine 100, the system detects the change in the angle A and the defined on-grade cell moves down the elongated receiver 128. When the angle A reaches 0° the on-grade cell is in its lowest position, see FIG. 2. The operator continues to move the downreach boom 108 towards the main body 106 of the machine 100 and the angle A begins to increase as a negative value. The defined on-grade cell now begins to move back up the elongated receiver 128 until the maximum angle in the negative direction is reached. The defined on-grade cell is once again in its highest position as shown in FIG. 2. The operator then scoops up the material that is in front of the bucket to complete a single digging cycle with the digging edge of the digging bucket 112 being on-grade under the control of the system of the present invention.

Having described the invention in detail and by way of reference to preferred embodiments thereof, it will be apparent that other modifications and variations are possible without departing from the scope of the invention defined in the appended claims.

What is claimed is:

1. Apparatus for controlling the working depth of a bucket of an excavating machine having an outreach boom which is pivotally attached at one end to said machine, a downreach boom pivotally attached to the opposite end of said outreach boom, a digging bucket pivotally attached to the end of said downreach boom opposite to that to which the outreach boom is attached, and power means for producing relative pivotal movements of the pivotally interconnected elements, said apparatus comprising:

laser beam projection means for projecting a beam of laser light at a reference height;

beam sensor means mounted on said outreach boom for detecting said beam of laser light, said beam sensor means defining a plurality of individual sensor locations sized such that one of said sensor locations can be identified as sensing said beam of laser light;

angle sensor means for detecting the angular orientation of said downreach boom relative to vertical; and control means connected to said beam sensor means and said angle sensor means for repetitively defining as a function of the angular orientation of said downreach boom one of said plurality of individual sensor locations as an on-grade sensor location for said beam sensor means, and for comparing said on-grade sensor location to the sensor location having detected said beam of laser light to generate an outreach boom adjustment signal representative of the movement of said outreach boom required to move the machine such that said on-grade sensor location is illuminated by said beam of laser light and thereby maintain said bucket on-grade as said downreach boom is pivoted with respect to said outreach boom.

2. Apparatus for controlling the working depth of a bucket of an excavating machine as claimed in claim 1 further comprising bucket control means for maintaining a fixed orientation of said bucket relative to vertical whereby the angle of attack of said bucket is constant throughout the digging stroke of said excavating machine.

3. Apparatus for controlling the working depth of a bucket of an excavating machine as claimed in claim 1 wherein said digging bucket is held in a fixed position with respect to said downreach boom.

4. Apparatus for controlling the working depth of a bucket of an excavating machine as claimed in claim 1 further comprising tilt sensor means for sensing a tilt angle of said excavating machine and wherein said control means is responsive to said tilt angle for defining said on-grade sensor location.

5. Apparatus for controlling the working depth of a bucket of an excavating machine as claimed in claim 1 wherein said control means comprises activation means responsive to said outreach boom adjustment signal for controlling the movement of said outreach boom to automatically maintain said bucket on-grade.

6. Apparatus for controlling the working depth of a bucket of an excavating machine as claimed in claim 1 wherein said beam sensor means is mounted at the pivoting interconnection of said downreach boom to said outreach boom.

7. Apparatus for controlling the working depth of a bucket of an excavating machine as claimed in claim 1 wherein said beam sensor means comprises a plurality of linearly arranged photocells, individual ones of said photocells defining said plurality of individual sensor locations.

8. Apparatus for controlling the working depth of a bucket of an excavating machine as claimed in claim 7 wherein said beam sensor means is adjustably mounted such that the height and the angular orientation relative to vertical of said beam sensor means can be adjusted.

9. Apparatus for controlling the working depth of a bucket of an excavating machine as claimed in claim 7 wherein said beam sensor means includes alignment means for maintaining said beam sensor means in a substantially vertical orientation.

10. Apparatus for controlling the working depth of a bucket of an excavating machine as claimed in claim 7 wherein said angle sensor means comprises an angle sensor mounted on said downreach boom.

11. Apparatus for controlling the working depth of a bucket of an excavating machine as claimed in claim 7 wherein said angle sensor means comprises an angle sensor mounted at the base of said outreach boom adjacent said machine and angle detection means for measuring the relative angle between said outreach boom and said downreach boom.

12. Apparatus for controlling the working depth of a bucket of an excavating machine as claimed in claim 7 wherein said angle sensor means comprises an angle sensor mounted on said machine and angle detection means for measuring the relative angles between said machine and said outreach boom and between said outreach boom and said downreach boom.

13. Apparatus for controlling the working depth of a bucket of an excavating machine with respect to a beam of laser light which is projected at a reference height, said excavating machine having an outreach boom which is pivotally attached at one end to said machine, a downreach boom pivotally attached to the opposite end of said outreach boom, a digging bucket pivotally attached to the end of said downreach boom opposite to that to which the outreach boom is attached, and power means for producing relative pivotal movements of the pivotally interconnected elements, said apparatus comprising:

beam sensor means mounted on said outreach boom for detecting said beam of laser light, said beam sensor means defining a plurality of individual sensor locations sized such that one of said sensor locations can be identified as sensing said beam of laser light;

angle sensor mans for detecting the angular orientation of said downreach boom relative to vertical; and control means connected to said beam sensor means and said angle sensor means for repetitively defining one of said plurality of individual sensor locations as an on-grade sensor location as a function of the angular orientation of said downreach boom, and for comparing said on-grade sensor location tot eh sensor location having detected said beam of laser light to generate an outreach boom adjustment signal representative of the movement of said outreach boom required to move the machine such that said on-grade sensor location is illuminated by said beam of laser light and thereby maintain said bucket on-grade as said downreach boom is pivoted with respect to said outreach boom.

14. Apparatus for controlling the working depth of a bucket of an excavating machine as claimed in claim 13 further comprising bucket control means for maintaining a fixed orientation of said bucket relative to vertical whereby the angle of attack of said bucket is constant throughout the digging stroke of said excavating machine.

15. Apparatus for controlling the working depth of a bucket of an excavating machine as claimed in claim 13 wherein said digging bucket is held in a fixed position with respect to said downreach boom.

16. Apparatus for controlling the working depth of a bucket of an excavating machine as claimed in claim 13 further comprising tilt sensor means for sensing a tilt angle of said excavating machine and wherein said control means is responsive to said tilt angle for defining said on-grade sensor location.

17. Apparatus for controlling the working depth of a bucket of an excavating machine as claimed in claim 13 wherein said control means comprises activation means responsive to said outreach boom adjustment signal for controlling the movement of said outreach boom to automatically maintain said bucket on-grade.

18. Apparatus for controlling the working depth of a bucket of an excavating machine as claimed in claim 13 wherein said beam sensor means is mounted at the pivoting interconnection of said downreach boom to said outreach boom.

19. Apparatus for controlling the working depth of a bucket of an excavating machine as claimed in claim 13 wherein said beam sensor means comprises a plurality of linearly arranged photocells, individual ones of said photocells defining said plurality of individual sensor locations.

20. Apparatus for controlling the working depth of a bucket of an excavating machine as claimed in claim 19 wherein said beam sensor means is adjustably mounted such that the height and the angular orientation relative to vertical of said beam sensor means can be adjusted.

21. Apparatus for controlling the working depth of a bucket of an excavating machine as claimed in claim 19 wherein said beam sensor means includes alignment means for maintaining said beam sensor means in a substantially vertical orientation.

22. Apparatus for controlling the working depth of a bucket of an excavating machine as claimed in claim 19 wherein said angle sensor means comprises an angle sensor mounted on said downreach boom.

23. Apparatus for controlling the working depth of a bucket of an excavating machine as claimed in claim 19 wherein said angle sensor means comprises an angle sensor mounted at the base of said outreach boom adjacent said machine and angle detection means for measuring the relative angle between said outreach boom and said downreach boom.

24. Apparatus for controlling the working depth of a bucket of an excavating machine as claimed in claim 19 wherein said angle sensor means comprises an angle sensor mounted on said machine and angle detection means for measuring the relative angles between said machine and said outreach boom and between said outreach boom and said downreach boom.

25. A method of controlling the working depth of a bucket of an excavating machine having an outreach boom which is pivotally attached at one end to said machine, a downreach boom pivotally attached to the opposite end of said outreach boom, a digging bucket pivotally attached to the end of said downreach boom opposite to that to which the outreach boom is attached, and power means for producing relative pivotal movements of the pivotally interconnected elements, said method comprising the steps of:

projecting a beam of laser light at a reference height;

detecting the beam of laser light by means of a beam sensor which defines a plurality of individual sensor locations sized such that only one of said sensor locations is currently sensing said beam of laser light;

detecting the angular orientation of said downreach boom relative to vertical;

defining one of said plurality of individual sensor locations as an on-grade sensor locations of said beam sensor as a function of the angular orientation of said downreach boom; and comparing said on-grade sensor location to the sensor location currently sensing said beam of laser light to generate an outreach boom adjustment signal representative of the movement of said outreach boom required to move the machine such that said on-grade sensor location is illuminated by said beam of laser light and thereby maintain said bucket on-grade as said downreach boom is pivoted with respect to said outreach boom.

26. A method of controlling the working depth of a bucket of an excavating machine as claimed in claim 25 further comprising the step of maintaining a fixed orientation of said bucket relative to vertical whereby the angle of attack of said bucket is constant throughout the digging stroke of said excavating machine.

27. A method of controlling the working depth of a bucket of an excavating machine as claimed in claim 25 further comprising the step of holding said bucket in a fixed position with respect to said downreach boom.

28. A method of controlling the working depth of a bucket of an excavating machine as claimed in claim 25 further comprising the step of sensing a tilt angle of said excavating machine and wherein the step of defining one of said plurality of individual sensor locations as an on-grade sensor location is responsive to said tilt angle.

29. A method of controlling the working depth of a bucket of an excavating machine as claimed in claim 25 further comprising the step of controlling the movement of said outreach boom in response to said outreach boom adjustment signal to automatically maintain said bucket on-grade.

30. A method of controlling the working depth of a bucket of an excavating machine with respect to a beam of laser light which is projected at a reference height, said excavating machine having an outreach boom which is pivotally attached at one end to said machine, a downreach boom pivotally attached to the opposite end of said outreach boom, a digging bucket pivotally attached to the end of said downreach boom opposite to that to which the outreach boom is attached, and power means for producing relative pivotal movements of the pivotally interconnected elements, said method comprising the steps of:

detecting the beam of laser light by means of a beam sensor which defines a plurality of individual sensor locations sized such that only one of said sensor locations is currently sensing said beam of laser light;

detecting the angular orientation of said downreach boom relative to vertical;

defining one of said plurality of individual sensor locations as an on-grade sensor location of said beam sensor as a function of the angular orientation of said downreach boom; and comparing said on-grade sensor location to the sensor location currently sensing said beam of laser light to generate an outreach boom adjustment signal representative of the movement of said outreach boom required to move the machine such that said on-grade sensor location is illuminated by said beam of laser light and thereby maintain said bucket on-grade as said downreach boom is pivoted with respect to said outreach boom.

31. A method of controlling the working depth of a bucket of an excavating machine as claimed in claim 30 further comprising the step of maintaining a fixed orientation of said bucket relative to vertical whereby the angle of attack of said bucket is constant throughout the digging stroke of said excavating machine.

32. A method of controlling the working depth of a bucket of an excavating machine as claimed in claim 30 further comprising the step of holding said bucket in a fixed position with respect to said downreach boom.

33. A method of controlling the working depth of a bucket of an excavating machine as claimed in claim 30 further comprising the step of sensing a tilt angle of said excavating machine and wherein the step of defining one of said plurality of individual sensor locations as an on-grade sensor location is responsive to said tilt angle.

34. A method of controlling the working depth of a bucket of an excavating machine as claimed in claim 30 further comprising the step of controlling the movement of said outreach boom in response to said outreach boom adjustment signal to automatically maintain said bucket on-grade.

* * * * *